US009761364B2

(12) United States Patent
Wardle et al.

(10) Patent No.: US 9,761,364 B2
(45) Date of Patent: Sep. 12, 2017

(54) METHODS AND SYSTEMS FOR A PUSH PIN ACTUATOR

(71) Applicant: HUSCO Automotive Holding LLC, Waukesha, WI (US)

(72) Inventors: Dean Wardle, Oconomowoc, WI (US); Kyle Stifter, Milwaukee, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 15/407,948

(22) Filed: Jan. 17, 2017

(65) Prior Publication Data

US 2017/0125147 A1 May 4, 2017

Related U.S. Application Data

(62) Division of application No. 14/926,087, filed on Oct. 29, 2015, now Pat. No. 9,583,249.

(Continued)

(51) Int. Cl.
*H01F 7/00* (2006.01)
*H01F 7/16* (2006.01)

(Continued)

(52) U.S. Cl.
CPC ..... *H01F 7/1615* (2013.01); *H01F 27/2823* (2013.01); *H01F 27/325* (2013.01);

(Continued)

(58) Field of Classification Search
CPC ..... H01H 7/10; H01H 7/16; H01H 7/1615; F01L 9/04; F01L 13/00; F01L 13/0036;

(Continued)

(56) References Cited

U.S. PATENT DOCUMENTS 1,202,895 A 10/1916 Rogers
2,708,561 A * 5/1955 Ehlke ..... F16K 11/04 137/599.08

(Continued)

FOREIGN PATENT DOCUMENTS

DE 102006035225 A1 2/2007
DE 102007028500 A1 12/2008

(Continued)

OTHER PUBLICATIONS

DE 102011009327 A1; machine translation; 8 pages; Sep. 28, 2016.
DE 102013206311 A1; machine translation; 17 pages; Sep. 28, 2016.

*Primary Examiner* — Shawki S Ismail
*Assistant Examiner* — Lisa Homza
(74) *Attorney, Agent, or Firm* — Quarles & Brady LLP

(57) ABSTRACT

A push pin actuator apparatus is provided. The push pin actuator apparatus includes a housing, a wire coil arranged within the housing and arranged around a first armature and a second armature. The first armature is coupled to a first push pin and the second armature is coupled to a second push pin. The push pin actuator apparatus further includes a first permanent magnet and a second permanent magnet. A first spring and a second spring are arranged within the housing. The first spring engages the first armature and the second spring engages the second armature. The first push pin is actuated in response to a current being applied to the wire coil in a first direction, and the second push pin is actuated in response to a current being applied to the wire coil in a second direction opposite to the first direction.

15 Claims, 12 Drawing Sheets

Related U.S. Application Data

(60) Provisional application No. 62/073,332, filed on Oct. 31, 2014.

(51) Int. Cl.
*H01F 27/28* (2006.01)
*H01F 27/32* (2006.01)
*F01L 1/04* (2006.01)
*F01L 9/04* (2006.01)

(52) U.S. Cl.
CPC . *F01L 1/04* (2013.01); *F01L 9/04* (2013.01); *F01L 2009/0401* (2013.01)

(58) Field of Classification Search
CPC . F16H 21/44; H01F 7/124; H01F 7/16; H01F 7/1646
USPC ..... 335/232
See application file for complete search history.

(56) References Cited

U.S. PATENT DOCUMENTS 4,191,937 A * 3/1980 Koehler ..... H01H 51/22 335/230
4,236,132 A * 11/1980 Zissimopoulos ..... H01F 7/14 335/193
4,494,572 A 1/1985 Loveless
4,779,582 A * 10/1988 Lequesne ..... F01L 9/04 123/90.11
4,847,581 A * 7/1989 Mohler ..... H01F 7/1646 335/229
4,851,801 A * 7/1989 Engel ..... H01H 51/2209 335/230
5,543,766 A * 8/1996 Bagalini ..... H01H 71/2409 335/172
6,702,252 B2 3/2004 Ben-Asher et al.
6,967,550 B2 11/2005 Elendt et al.
6,991,187 B2 1/2006 Czimmek
7,048,209 B2 5/2006 Czimmek
7,219,697 B2 5/2007 Neumair et al.
7,965,161 B2 * 6/2011 Roche ..... H01F 7/122 335/136
8,176,887 B2 5/2012 Golz et al.
8,186,320 B2 5/2012 Schiepp et al.
8,203,405 B2 6/2012 Golz et al.
8,228,150 B2 7/2012 Golz et al.
8,448,615 B2 5/2013 Laufenberg et al.
8,493,166 B2 7/2013 Golz et al.
8,707,917 B2 4/2014 Schiepp
8,729,991 B2 * 5/2014 Nishimura ..... H01F 5/04 335/219
8,729,992 B2 5/2014 Schiepp et al.
8,851,035 B2 * 10/2014 Gunnel ..... F01L 13/0036 123/90.18
8,997,702 B2 * 4/2015 Popp ..... F16H 21/44 123/90.11
9,074,496 B2 * 7/2015 Schuler ..... F01L 13/0036
9,080,654 B2 * 7/2015 Heinemann ..... F01L 1/053
9,305,728 B2 * 4/2016 Suzuki ..... F01L 13/0036
9,318,247 B2 * 4/2016 Schiepp ..... H01F 7/121
2010/0180850 A1 * 7/2010 Lengfeld ..... F01L 13/06 123/188.1
2011/0240892 A1 * 10/2011 Nendel ..... F01L 1/047 251/129.01
2013/0000581 A1 * 1/2013 Popp ..... F01L 1/047 123/90.18
2013/0113582 A1 5/2013 Schiepp et al.
2013/0127572 A1 5/2013 Golz
2013/0147583 A1 6/2013 Schiepp et al.
2014/0137820 A1 5/2014 Golz
2014/0190430 A1 7/2014 Werner et al.
2016/0125990 A1 * 5/2016 Strigerwald ..... F01L 13/0036 335/229

FOREIGN PATENT DOCUMENTS

DE 202009001187 U1 6/2010
DE 102009039562 A1 3/2011
DE 102010045601 A1 3/2012
DE 202011001412 U1 4/2012
DE 102011009327 A1 7/2012
DE 202012104122 U1 3/2013
DE 102012101619 A1 8/2013
DE 102012101632 A1 8/2013
DE 102012103796 A1 10/2013
DE 102013206311 A1 11/2013
DE 102012111851 A1 6/2014
DE 102012113056 A1 6/2014
WO 2012007279 A2 1/2012
WO 2014016023 A2 1/2014
WO 2014023451 A1 2/2014

* cited by examiner

METHODS AND SYSTEMS FOR A PUSH PIN ACTUATOR

CROSS-REFERENCES TO RELATED APPLICATIONS

The present application is a divisional of co-pending U.S. patent application Ser. No. 14/926,087, filed Oct. 29, 2015, and entitled "Methods and Systems for Push Pin Actuator," which claims priority to U.S. Provisional Patent Application No. 62/073,332, filed Oct. 31, 2014, and entitled "Methods and Systems For Push Pin Actuator," each of which are incorporated herein by reference in their entirety.

STATEMENT REGARDING FEDERALLY SPONSORED RESEARCH

Not Applicable.

BACKGROUND

The present invention relates generally to push pin actuators and, more specifically, to independent, dual push pin actuators.

Internal combustion (IC) engines are heavily used in automotive, power generation, off-highway, and pump applications. Currently, one of the primary goals in IC engine development is to reduce fuel consumption and carbon dioxide ($CO_2$) emissions. Varying intake and/or exhaust valve timing (i.e., when the valve events occur with respect to the rotation of the crank shaft) in IC engines has been found to reduce fuel consumption and $CO_2$ emissions. Typically, a rotational relationship between the cam shaft (which is coupled to the intake and exhaust valves) and the crank shaft in an IC engine can be varied (i.e., advanced or retarded) by a cam phasing system. Alternatively or additionally, a profile of a lobe on the cam shaft can vary in shape to change the lift profiles of the intake and exhaust valves. Cam profile switching systems can be used to alter between one or more cam lift profiles for the intake and/or exhaust valves. For example, the cam profile switching system may include a cam lobe with a profile which results in no valve lift for a cylinder deactivation operating condition.

FIG. 1 shows a prior art cam profile switching system 100. The cam profile switching system 100 includes solenoid actuators 102 and 104 coupled to push pins 106 and 108, respectively. The solenoid actuators 102 and 104 are configured to fire (i.e., actuate or displace) the push pins 106 and 108 into a respective groove 110 and 112 on the cam shaft 114. The grooves 110 and 112 define spiral profiles. As shown in FIG. 1, the actuator 104 is firing the push pin 108 towards the groove 112. As the push pin 108 seats in the groove 112 and the cam shaft 114 is rotated, the push pin 108 shifts the cam shaft 114 thereby shifting to another cam lobe with a different profile. The push pin 108 is retracted into the actuator 104 by the rotation of the cam shaft 114. Similarly, the push pin 106 can be fired by the actuator 102 to shift the cam shaft 114 back to its original position. In other cam profile switching systems, multiple grooves are added to enable the shifting between more than two cam lobes with different profiles.

Some cam profile switching systems combine actuators into a single package with multiple push pins. Combining the actuators into a single package can allow for a smaller overall package, but these systems do not allow for multiple push pins to extend towards the cam shaft and retract away from the cam shaft independently without assistance from the cam shaft. Additionally, performance with multiple actuators can be hindered due to increased friction from inherent side loading between close proximity actuators combined into a single package.

SUMMARY OF THE INVENTION

The above-mentioned deficiencies can be overcome by providing a push pin actuator apparatus that includes one or more permanent magnets, and can independently actuate a first armature and a second armature between a first position and a second position. The push pin actuator can include one or more pole pieces to reduce side loading (i.e., friction) between a first armature and a second armature.

In one aspect, the present invention provides a push pin actuator apparatus including a housing, a wire coil arranged within the housing and arranged around a first armature and a second armature. The first armature is coupled to a first push pin and the second armature is coupled to a second push pin. The first armature and the second armature are each movable between a first armature position and a second armature position. The push pin actuator apparatus further includes a first permanent magnet and a second permanent magnet arranged on opposing sides of the first armature, and a third permanent magnet and a fourth permanent magnet arranged on opposing sides of the second armature. The first push pin is actuated in response to a current being applied to the wire coil in a first direction, and the second push pin is actuated in response to a current being applied to the wire coil in a second direction opposite to the first direction.

In some embodiments, the first permanent magnet and the second permanent magnet define directionally opposite magnetic polarities.

In some embodiments, the third permanent magnet and the fourth permanent magnet define directionally opposite magnetic polarities.

In some embodiments, the push pin actuator apparatus further includes a first pole piece and a second pole piece arranged within the housing on opposing sides of the wire coil.

In some embodiments, the first pole piece includes a first pole piece cutout to receive the first armature and the second armature, and the second pole piece includes a second pole piece cutout to receive the first armature and the second armature.

In some embodiments, the first pole piece cutout eccentrically receives the first armature and the second armature, and the second pole piece cutout eccentrically receives the first armature and the second armature.

In some embodiments, the first pole piece cutout defines a first section for receiving the first armature and a second section for receiving the second armature.

In some embodiments, the second pole piece cutout defines a first section for receiving the first armature and a second section for receiving the second armature.

In some embodiments, when the current is applied to the wire coil in the first direction, the second push pin is not actuated.

In some embodiments, when the current is applied to the wire coil in the second direction, the first push pin is not actuated.

In some embodiments, the push pin actuator apparatus further includes a hall effect sensor to measure a position of the first armature and the second armature between the first armature position and the second armature position.

In some embodiments, the first armature and the second armature are fabricated from a magnetic material.

In some embodiments, the first armature is coupled to the first push pin by a first coupling rod, and the second armature is coupled to the second push pin by a second coupling rod.

In some embodiments, the first coupling rod and the second coupling rod are fabricated from a non-magnetic material.

In another aspect, the present invention provides a push pin actuator apparatus including a housing, a wire coil arranged within the housing and arranged around a first armature and a second armature. The first armature is coupled to a first push pin and the second armature is coupled to a second push pin. The first armature and the second armature are each movable between a first armature position and a second armature position. The push pin actuator apparatus further includes a first permanent magnet arranged adjacent to a first surface of the first armature, a second permanent magnet arranged adjacent to a first surface of the second armature, a pole piece arranged within the housing and including a cutout for receiving the first armature and the second armature, and a first spring and a second spring each arranged within the housing. The first spring engaging the first armature and the second spring engaging the second armature. The first push pin is actuated in response to a current being applied to the wire coil in a first direction, and the second push pin is actuated in response to a current being applied to the wire coil in a second direction opposite to the first direction.

In some embodiments, the first spring retracts the first armature from the second armature position to the first armature position when the current applied to the wire coil in the first direction is removed, and the second spring retracts the second armature from the second armature position to the first armature position when the current applied to the wire coil in the second direction is removed.

In some embodiments, the first spring extends the first armature from the first armature position to the second armature position when the current in the first direction is applied to the wire coil, and the second spring extends the second armature from the first armature position to the second armature position when the current in the second direction is applied to the wire coil.

In some embodiments, the cutout of the pole piece eccentrically receives the first armature and the second armature.

In yet another aspect, the present invention provides a pole piece for a push pin actuator apparatus. The push pin actuator apparatus includes a first armature and a second armature each movable between a first armature position and a second armature position. The pole piece includes a cutout defining a first section for receiving the first armature and a second section for receiving the second armature. The first armature is eccentrically received within the first section and the second armature is eccentrically received within the second section.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention

DESCRIPTION OF DRAWINGS

The invention will be better understood and features, aspects and advantages other than those set forth above will become apparent when consideration is given to the following detailed description thereof. Such detailed description makes reference to the following drawings

DETAILED DESCRIPTION OF THE INVENTION

Figure 1:
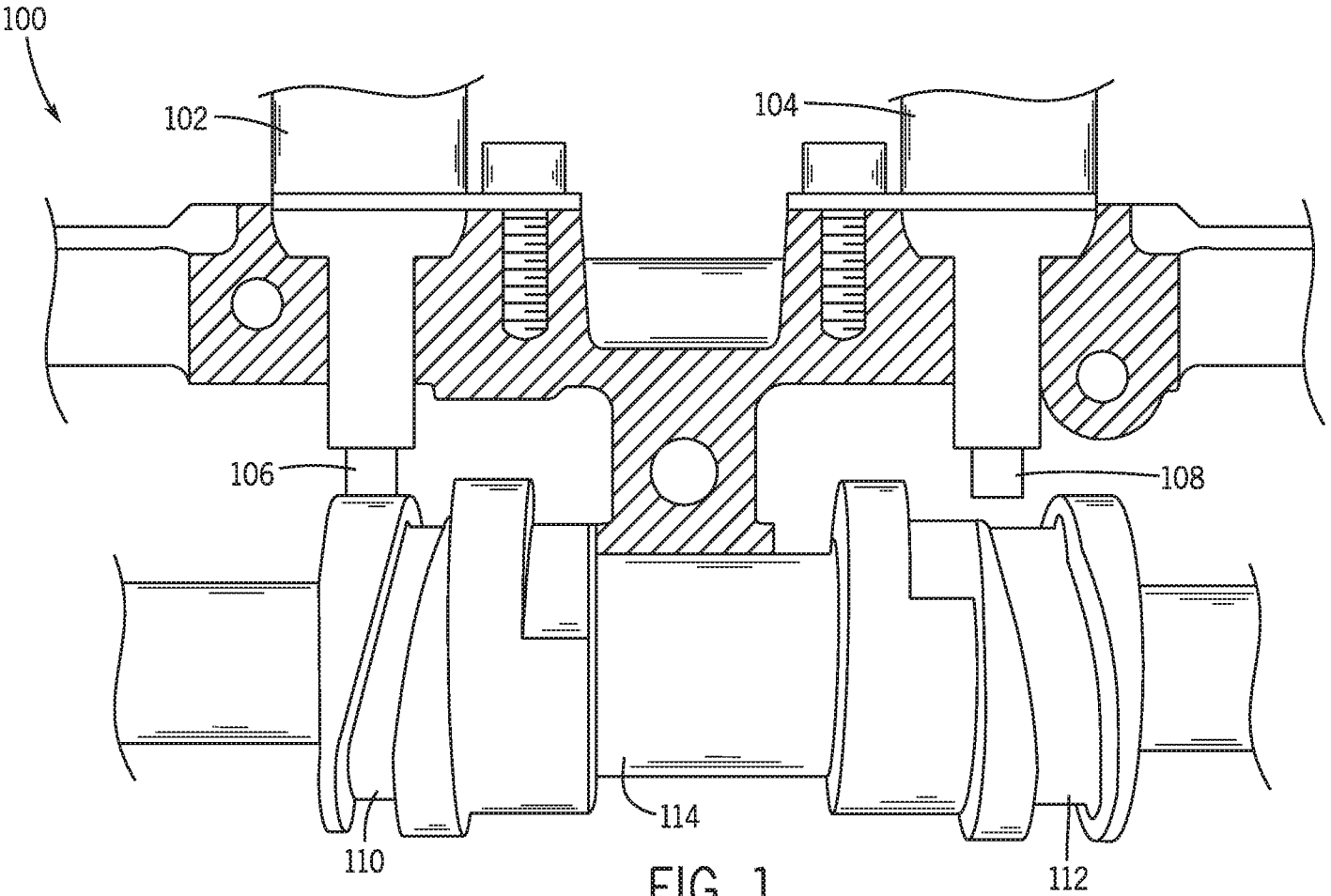
FIG. 1 (PRIOR ART)
FIG. 1 shows a schematic of a prior art cam profile switching system.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. In addition, references herein to directional relationships and movement such as upper and lower, left and right, top and bottom, or clockwise and counterclockwise, refer to the relationship and movement of the components in the orientation illustrated in the drawings, which may not be the orientation of the components in practice. The use of "including," "comprising," or "having" and variations thereof herein is meant to encompass the items listed thereafter and equivalents thereof as well as additional items. Unless specified or limited otherwise, the terms "mounted," "connected," "supported," and "coupled"

and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
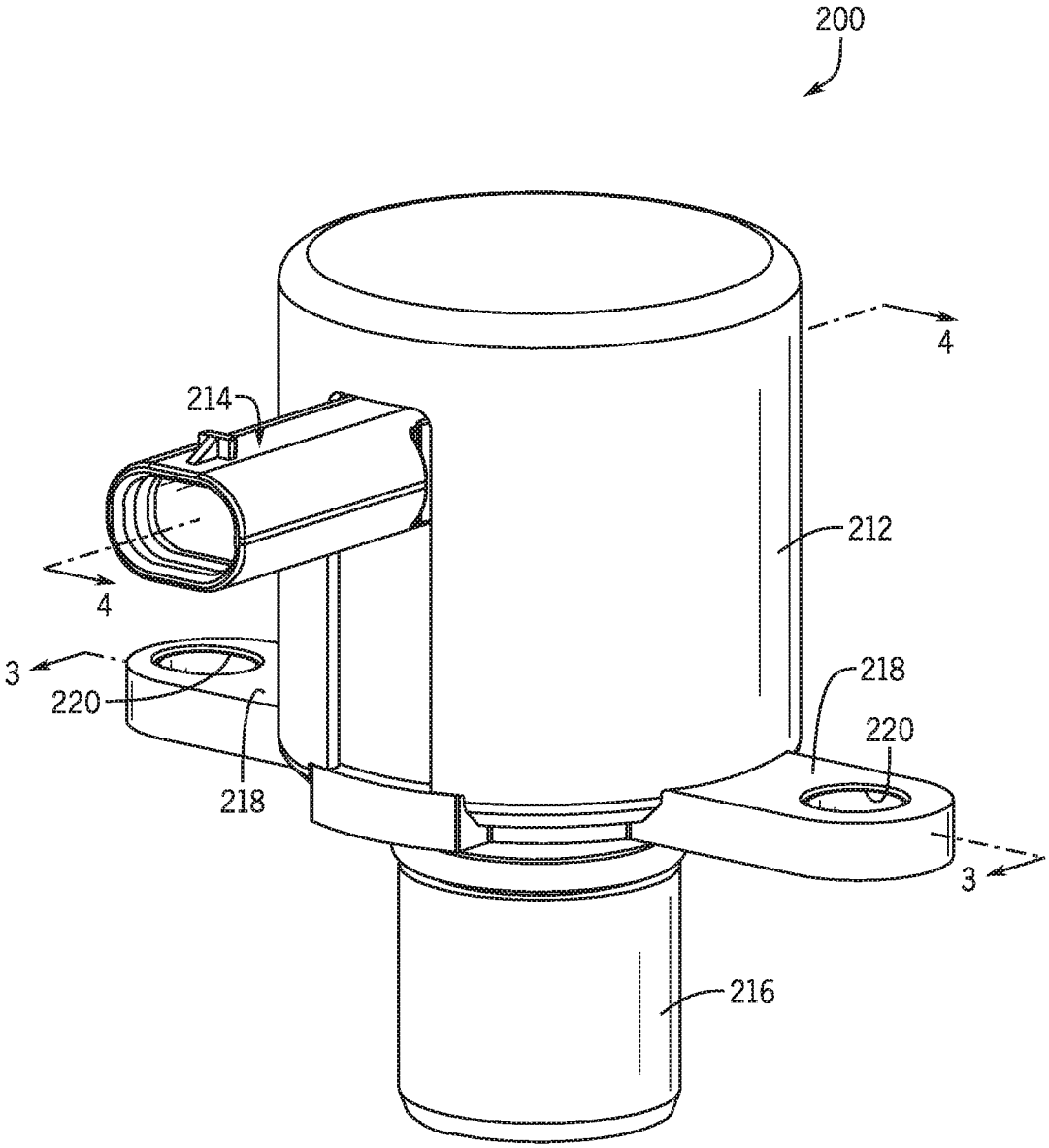
FIG. 2 shows a perspective view of a push pin actuator apparatus according to one embodiment of the present invention.

FIG. 2 shows a push pin actuator apparatus 200 for a cam profile switching system according to one embodiment of the present invention. The push pin actuator apparatus 200 can include a housing 212, a connector 214, and a pin body 216. The housing 212 can be fabricated from a metal material, and the connector 214 can be fabricated from a plastic material. The connector 214 is configured to receive an input connector (not shown) which is in communication with a controller (not shown), for example, an engine control module (ECM).

The push pin actuator apparatus 200 can include a pair of mounting flanges 218 extending from the housing 212 each having a mounting aperture 220. The mounting flanges 218 can enable the push pin apparatus 200 to be rigidly mounted adjacent to the cam profile switching system. For example, a fastening element (not shown) can be received by the mounting apertures 220. It should be known that the use of the flanges 218 to mount the push pin actuator apparatus 200 is not meant to be limiting in any way, and other mounting mechanisms are within the scope of the present invention.

Figure 3:
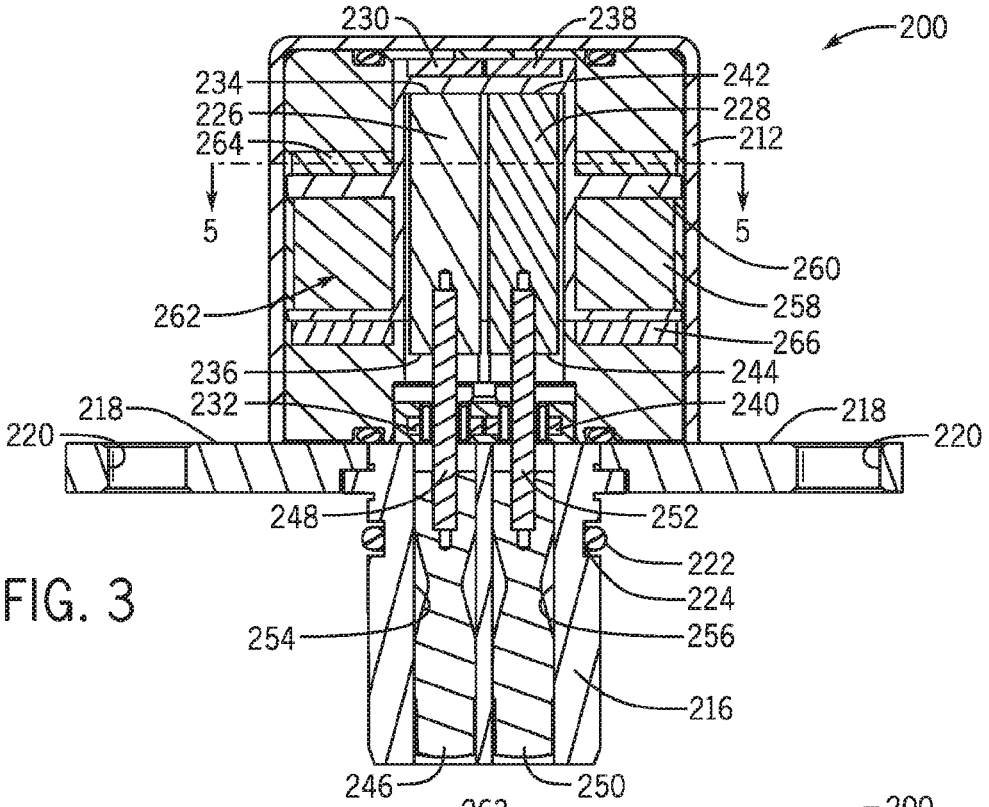
FIG. 3 shows a cross-sectional view of the push pin actuator apparatus of FIG. 2 taken along line 3-3.
Figure 4:
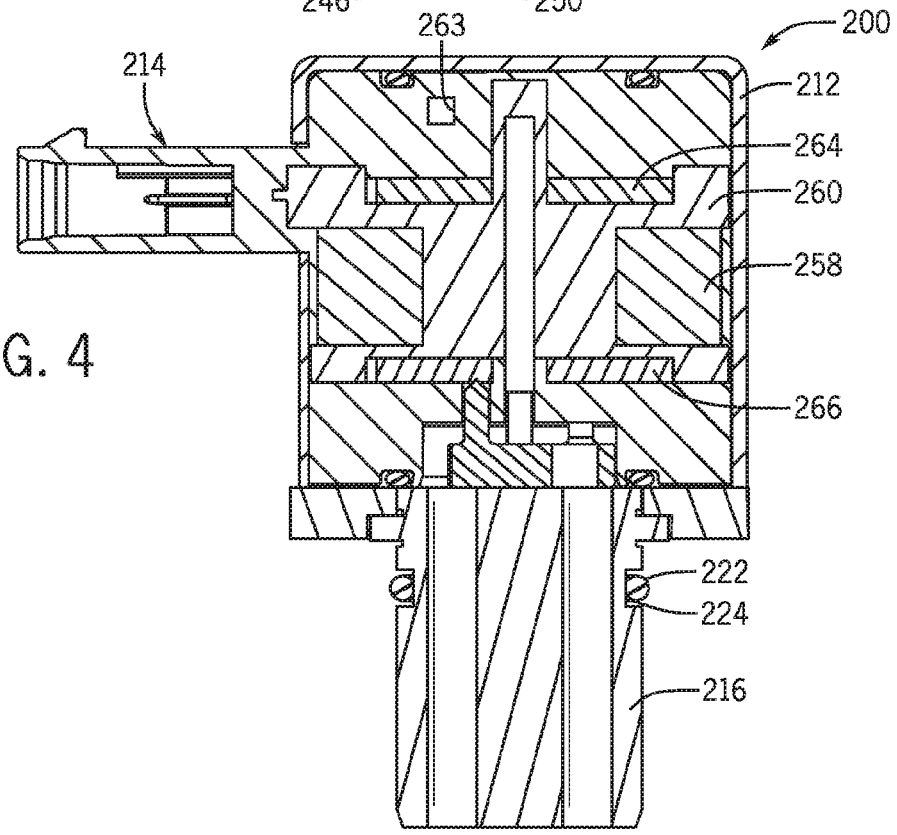
FIG. 4 shows a cross-sectional view of the push pin actuator apparatus of FIG. 3 taken along line 4-4.

Turning to FIGS. 3 and 4, the pin body 216 can be coupled to flanges 218 and thereby to the housing 212. The pin body 216 can include a pin body o-ring 222 received within a pin body groove 224. The pin body o-ring 222 can be configured to provide a seal between the pin body 216 and a mounting surface (not shown) to which the push pin actuator apparatus 200 is mounted.

The push pin apparatus 200 can include a first armature 226 and a second armature 228 each arranged within the housing 212. The first armature 226 and the second armature 228 can be fabricated from a magnetic material (e.g., a magnetic steel or iron). A first permanent magnet 230 and a second permanent magnet 232 can be arranged on opposing sides of the first armature 226. That is, the first permanent magnet 230 can be arranged adjacent to a first surface 234 of the first armature 226, and the second permanent magnet 232 can be arranged adjacent to a second surface 236 of the first armature 226 opposing the first surface 234. Similarly, a third permanent magnet 238 and a fourth permanent magnet 240 can be arranged on opposing sides of the second armature 228. The third permanent magnet 238 can be arranged adjacent to a first surface 242 of the second armature 228, and the fourth permanent magnet 240 can be arranged adjacent to a second surface 244 of the second armature 228.

The first permanent magnet 230 and the third permanent magnet 238 can be arranged at substantially similar heights within the housing 212 and can define directionally opposite magnetic polarities. The second permanent magnet 232 and the fourth permanent magnet 240 can be arranged at substantially similar heights within the housing 212 and can define directionally opposite magnetic polarities.

In the illustrated embodiment, the first permanent magnet 230 and the third permanent 238 can produce stronger magnetic fields (i.e., magnetic forces) than then second permanent magnet 232 and the fourth permanent magnet 240. In other embodiments, the first permanent magnet 230 and the third permanent magnet 238 can produce similar strength magnetic fields (i.e., magnetic forces) as the second permanent magnet 232 and the fourth permanent magnet 240.

The first armature 226 can be coupled to a first push pin 246 by a first coupling rod 248, and the second armature 228 can be coupled to a second push pin 250 by a second coupling rod 252. The first push pin 246 and the second push pin 250 can be configured to be received in respective grooves (not shown) of a cam profile switching system. The first push pin 246 can be slidably received within a first passage 254 defined by the pin body 216, and the second push pin 250 can be slidably received within a second passage 256 defined by the pin body 216. The first push pin 246 and the second push pin 250 can be fabricated from a hardened metal material to prevent wearing of the first and second push pins 246 and 250. The first coupling rod 248 and the second coupling rod 252 can be fabricated from a non-magnetic material. The first armature 226 and the second armature 228 and thereby the first push pin 246 and the second push pin 250 are movable between a first armature position and a second armature position, as will be described in detail below.

The push pin actuator apparatus 200 can include a wire coil 258 arranged within the housing 212 and can be wrapped around a bobbin 260. The bobbin 260 can define a recess 262 which receives the wire coil 258 and can position the wire coil 258 around the first armature 226 and the second armature 228. The wire coil 258 can be fabricated, for example, from a copper coil that can be configured to produce a magnetic field, and thereby apply a force, in response to a current being applied to the wire coil 258. The direction and magnitude of the magnetic field, and the force, produced by the wire coil 258 can be determined by the direction and magnitude of the current applied to the wire coil 258. The bobbin 260 can be fabricated from a non-magnetic material. The wire coil 258 can define a thickness, or height, which is approximately less than a distance between the first surface 234 and the second surface 236 of the first armature 226.

With specific reference to FIG. 4, the push pin actuator apparatus 200 can include a sensor 263 arranged within the housing 212. The sensor 263 can be configured to measure a position of the first armature 226 and the second armature 228. In one embodiment, the sensor 263 can be a hall effect sensor.

Figure 5:
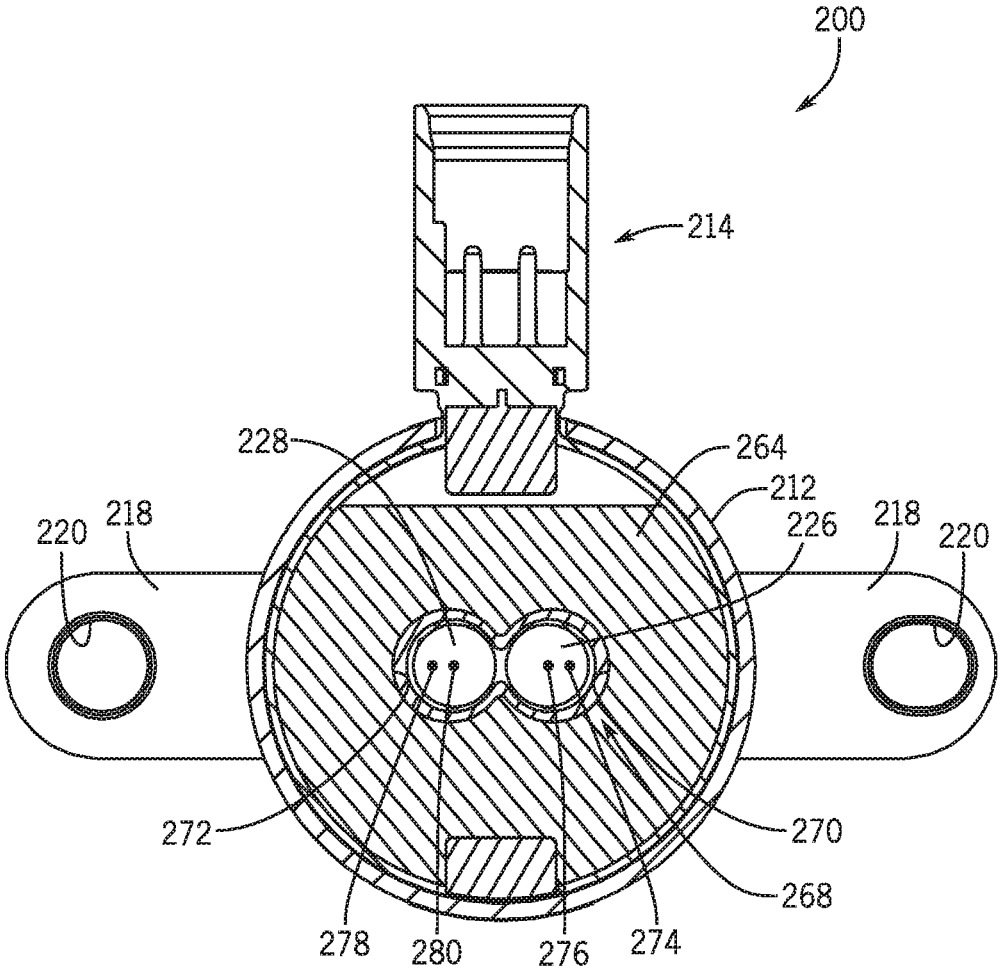
FIG. 5 shows a cross-sectional view of the push pin actuator apparatus of FIG. 3 taken along like 5-5.

The push pin actuator apparatus 200 can include a first pole piece 264 and a second pole piece 266 arranged within the housing 212 on opposing sides of the wire coil 258. The first pole piece 264 and the second pole piece 266 can be fabricated from a magnetic material. The first pole piece 264 can be similar to the second pole piece 266. Therefore, the following description of the first pole piece 264 also applies to the second pole piece 266. Turning to FIG. 5, the first pole piece 264 includes a cutout 268 for receiving the first armature 226 and the second armature 228. Specifically, the cutout 268 defines a first round section 270 for receiving the first armature 226 and a second round section 272 for receiving the second armature 228. The cutout 268 can eccentrically receive the first armature 226 and the second armature 228. That is, the first round section 270 defines a first section center point 274 which is offset from a first armature center point 276 defined by the first armature 226, and the second round section 272 defines a second section center point 278 which is offset from a second armature center point 280 defined by the second armature 228. In other embodiments, the cutout 268 can define a different shape, as desired, as long as the eccentric arrangement between the cutout 268 and the first armature 226 and the second armature 228 is maintained. For example, the cutout 268 can include one or more oval sections for eccentrically receiving the first armature 226 and the second armature 228.

Figure 6:
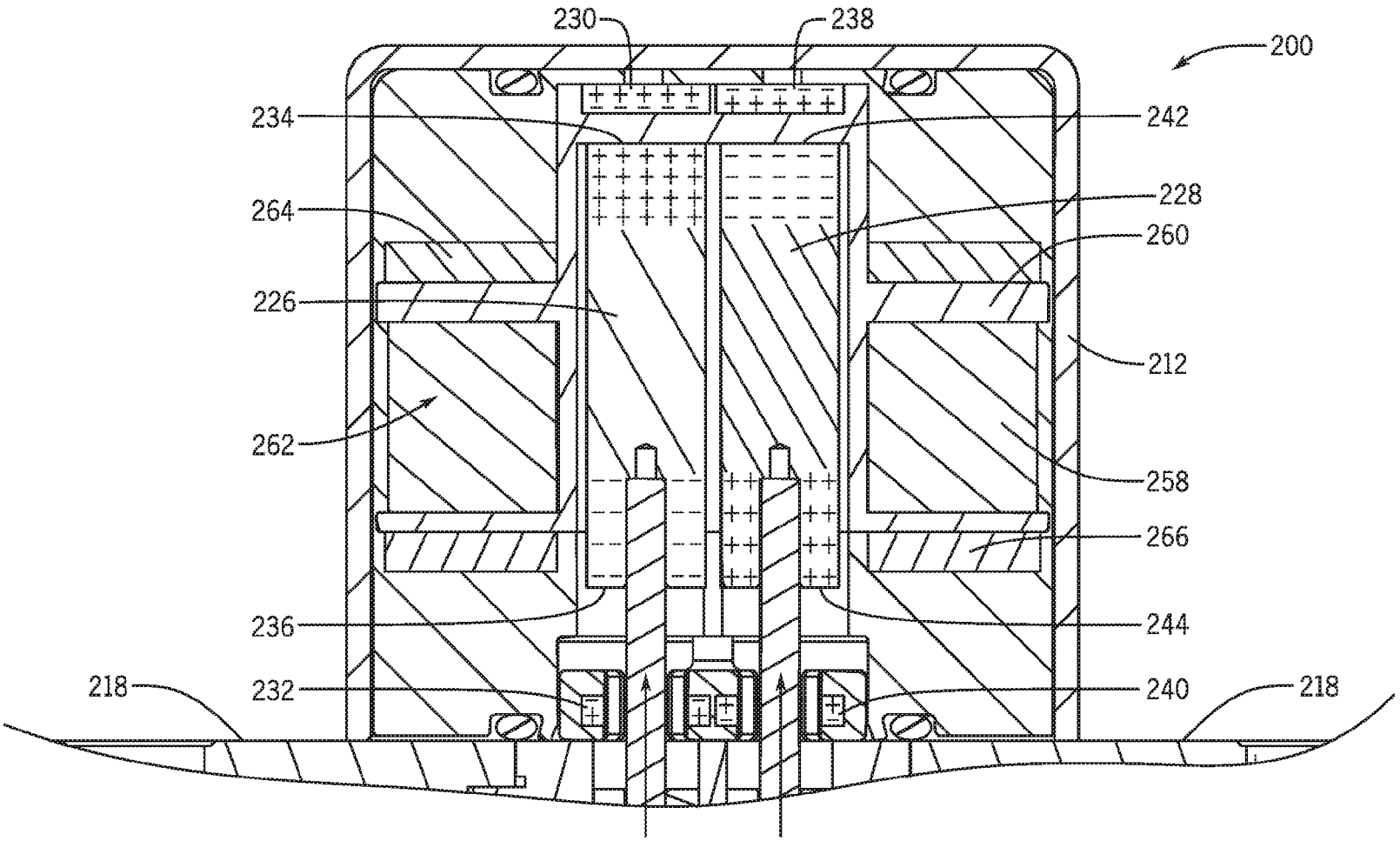
FIG. 6 shows an enlarged portion of the cross-sectional view of the push pin actuator apparatus of FIG. 3 with no current applied to a wire coil.

One non-limiting example of the operation of the push pin actuator apparatus 200 will be described with reference to FIGS. 6-9. FIG. 6 shows the push pin actuator apparatus 200 when no current is applied to the wire coil 258. As shown in FIG. 6, the first armature 226 and the second armature 228 are in a first armature position. When the first armature 226 and the second armature 228 are in the first armature position, the first push pin 246 and the second push pin 250 can be retracted into (i.e., not protruding from) the push pin body 216. With no current applied to the wire coil 258, the first permanent magnet 230 and the second permanent magnet 238 can magnetically attract, or retain, the first armature 226 and the second armature 228 in the first armature position. The first permanent magnet 230 can induce a positive magnetic pole in the first armature 226 adjacent to the first surface 234, and the third permanent magnet 238 can induce a negative magnetic pole in the second armature 228 adjacent to the first surface 242.

Figure 7:
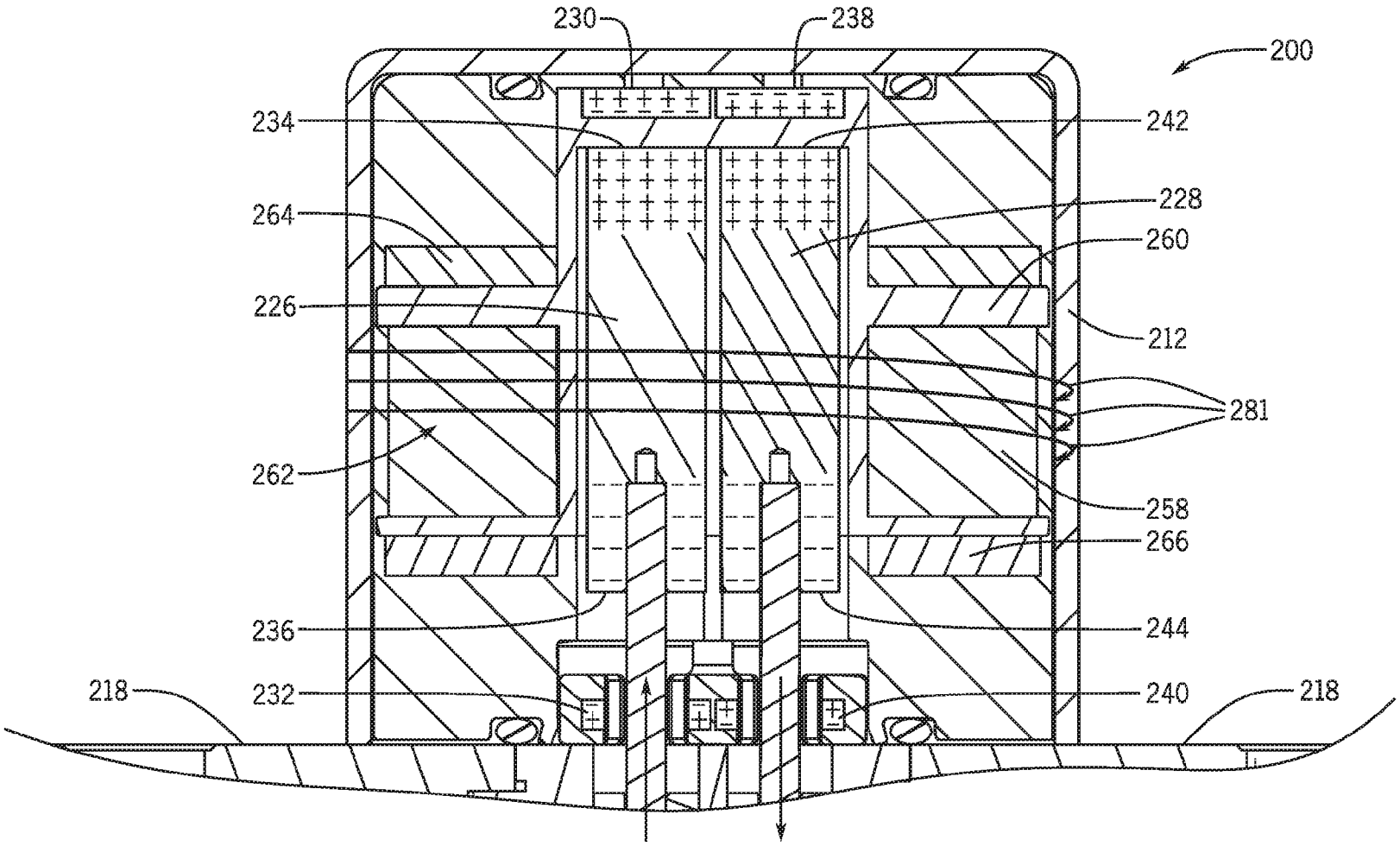
FIG. 7 shows an enlarged portion of the cross-sectional view of the push pin actuator apparatus of FIG. 3 with a current applied to a wire coil in a first direction.

Turing to FIG. 7, when a high level current (e.g., 75% to 100% of a maximum current) is applied to the wire coil 258 in a first direction 281, a magnetic field produced by current in the wire coil 258 can reverse the polarity in the second armature 228. That is, a positive magnetic pole can be induced in the second armature 228 adjacent to the first surface 242. Reversing the polarity in the second armature 228 can cause the second armature 228 to be repelled by the third permanent magnet 238. This repulsion can cause the second armature 228 and thereby the second push pin 250 to actuate away from the third permanent magnet 238 towards a second armature position. Since the first permanent magnet 230 already induces a positive magnetic pole in the first armature 226 adjacent to the first surface 234, the magnetic field produced by the current in the wire coil 258 can strengthen the attraction between the first armature 226 and the first permanent magnet 230. Thus, applying the high level current to the wire coil 258 in the first direction can retain the first armature 226 in the first armature position and cause the second armature 228 to actuate towards the second armature position.

Figure 8:
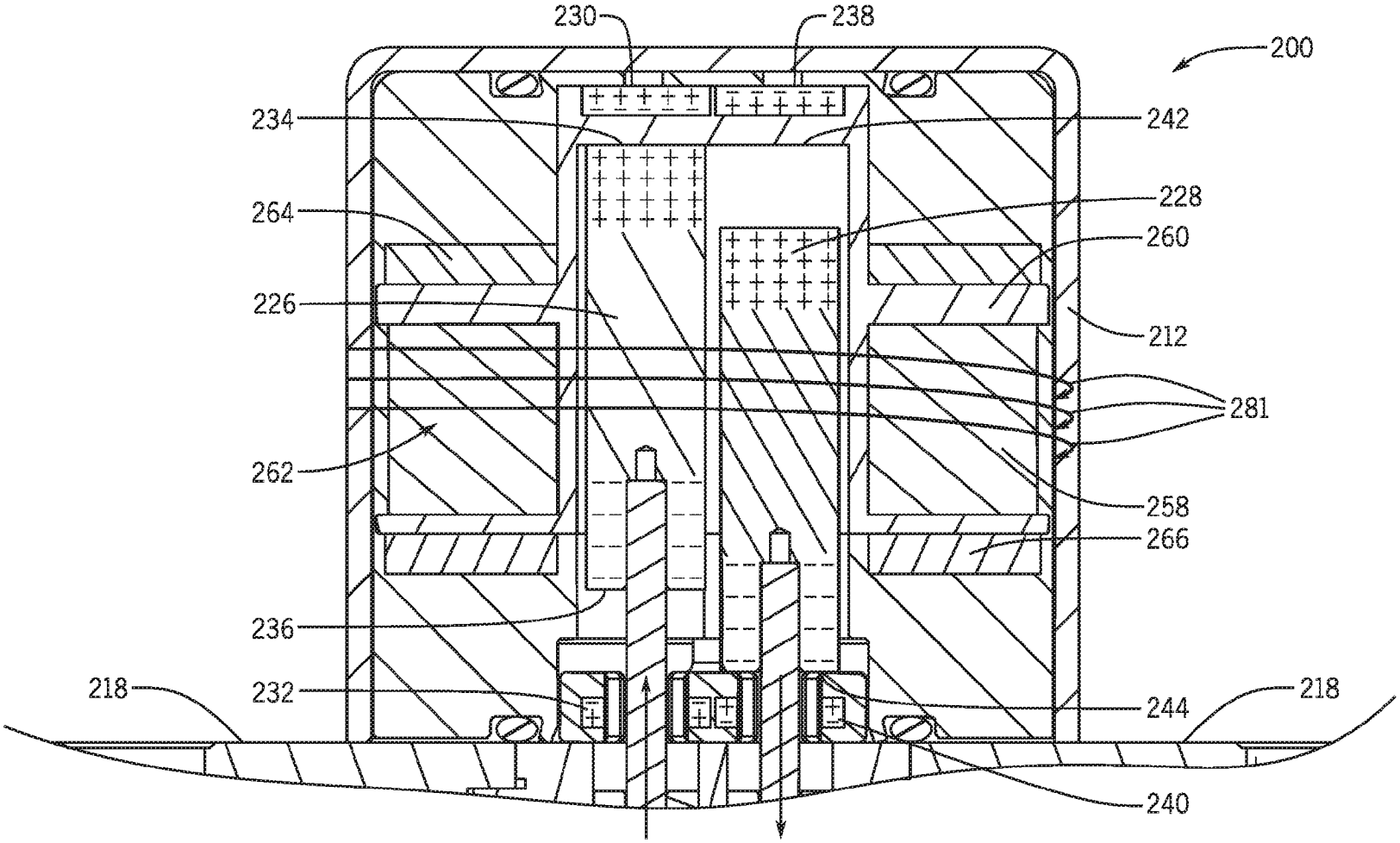
FIG. 8 shows an enlarged portion of the cross-sectional view of the push pin actuator apparatus of FIG. 3 with a current applied to a wire coil in a first direction and a second armature actuated.

FIG. 8 shows the second armature 228 in the second armature position. When the second armature 228 is in the second armature position, the second push pin 250 can protrude from the push pin body 216. If the application of the high level current to the wire coil 258 in the first direction is continued, the second armature 228 can have a maximum holding force. That is, a force on the second armature 228 in a direction away from the third permanent magnet 238 can be at a maximum value. If the current is removed from the wire coil 258, the first permanent magnet 230 can retain the first armature 226 in the first armature position, and the fourth permanent magnet 240 can retain the second armature 228 in the second armature position. Thus, the push pin actuator apparatus 200 may not require continuous current to be applied to the wire coil 258 following actuation of either the first armature 226 or the second armature 228 from the first armature position to the second armature position.

Figure 9:
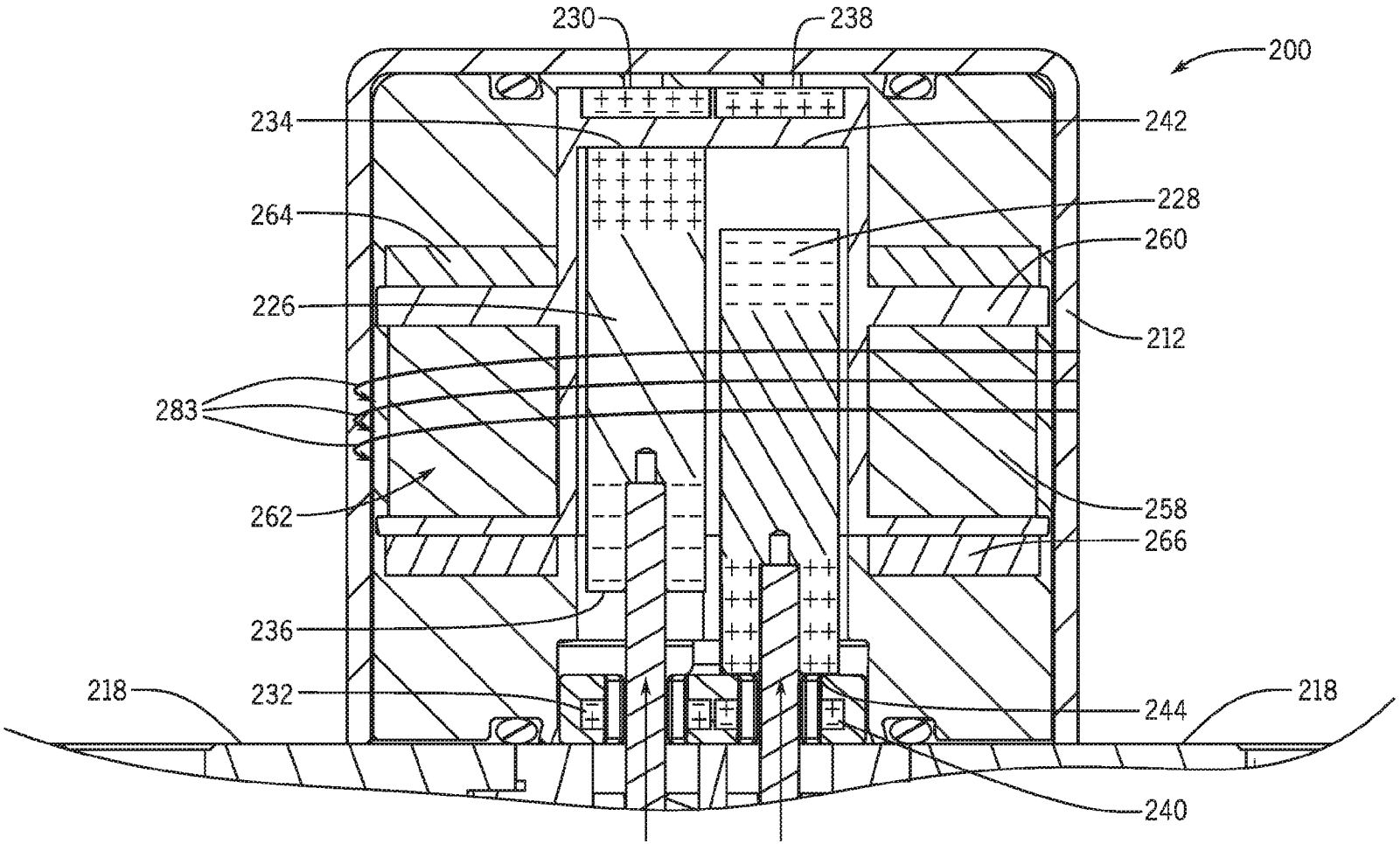
FIG. 9 shows an enlarged portion of the cross-sectional view of the push pin actuator apparatus of FIG. 3 with a current applied to a wire coil in a second direction.

Turning to FIG. 9, when a low level current (e.g., 40% to 60% of a maximum current) is applied to the wire coil 258 in a second direction 283 opposite to the first direction 281, a magnetic field produced by current in the wire coil 258 can switch back the polarity in the second armature 228 to a negative magnetic pole in the second armature 228 adjacent to the first surface 242. The change in polarity in the second armature 228 can occur because the low level current applied to the wire coil 258 in the second direction can induce a magnetic field that overcomes the magnetic field of the fourth magnet 240. This can cause the second armature 228 to actuate back towards the first armature position and thereby retract the second push pin 250 into the push pin body 216.

As described above, the first permanent magnet 230 can produce stronger magnetic fields (i.e., magnetic forces) than then second permanent magnet 232. This can allow the first armature 226 to remain in the first armature position because the magnetic field induced by the low level current applied to the wire coil 258 in the second direction may not be strong enough to over come the attraction of the first armature 226 to the first permanent magnet 230.

Although the operation of the push pin actuator apparatus 200 was described above with respect to actuating the second armature 228, the operation of the push pin actuator apparatus 200 would be substantially similar to when actuating the first armature 226 except the directions of the currents applied to the wire coil 258 would be reversed. That is, to actuate the first armature 226 and thereby the first push pin 246, from the first actuation position to the second actuation position, a high level current can be applied to the wire coil 258 in the second direction. Then, to actuate the first armature 226 and thereby the first push pin 246 from the second armature position to the first armature position, a low level current can be applied to the wire coil 258 in the first direction. Table 1 below shows seven different operating modes for the push pin actuator apparatus 200:

TABLE 1

| Mode Description | First Push Pin | Second Push Pin | Current Applied (% Max Current) |
|---|---|---|---|
| Initial Position (FIG. 6) | Retracted | Retracted | Off (0%) |
| Extend Second Armature 228 (FIG. 7) | Retracted | Extending | High First Direction (75-100%) |
| Extended Second Armature 228 (FIG. 8) | Retracted | Extended | Off (0%) |
| Retracting Second Armature 228 (FIG. 9) | Retracted | Retracting | Low Second Direction (40-60%) |
| Extending First Armature 226 | Extending | Retracted | High Second Direction (75-100%) |
| Extended First Armature 226 | Extended | Retracted | Off (0%) |
| Retracting First Armature 226 | Retracting | Retracted | Low First Direction (40-60%) |

The set of percent ranges in Table 1 are merely an example of one non-limiting example of potential set percent ranges for the current, and it should be appreciated that other percent ranges may be possible.

During actuation of either the first armature 226 or the second armature 228 between the first armature position and the second armature position, friction, or a side loading effect, can occur between the first armature 226 and the second armature 228 due to the close proximity of the magnetized armatures 226 and 228. The use and arrangement of the first pole piece 264 and the second pole piece 266 can substantially cancel this side loading effect. Specifically, the eccentric arrangement between the cutout 268 and the first armature 226 and the second armature 228 can aid in cancelling the side loading effect. Also, as shown in FIG. 9, the first pole piece 264 can be arranged at a height within the housing 212 which is generally aligned with a height of the first surface 242 of the second armature 228 when the second armature 228 is in the second armature position. The second pole piece 266 can be arranged at a height within the housing 212 which is generally aligned with a height of the second surface 236 of the first armature 226 when the first armature 226 is in the first armature position.

The first pole piece 264 and the second pole piece 266 can also increase an output force applied to the first push pin 246 and the second push pin 250 by the magnetic actuation of the first armature 226 and the second armature 228 compared to if the first pole piece 264 and the second pole piece 266 were not included in the push pin actuator apparatus 200.

Figure 10:
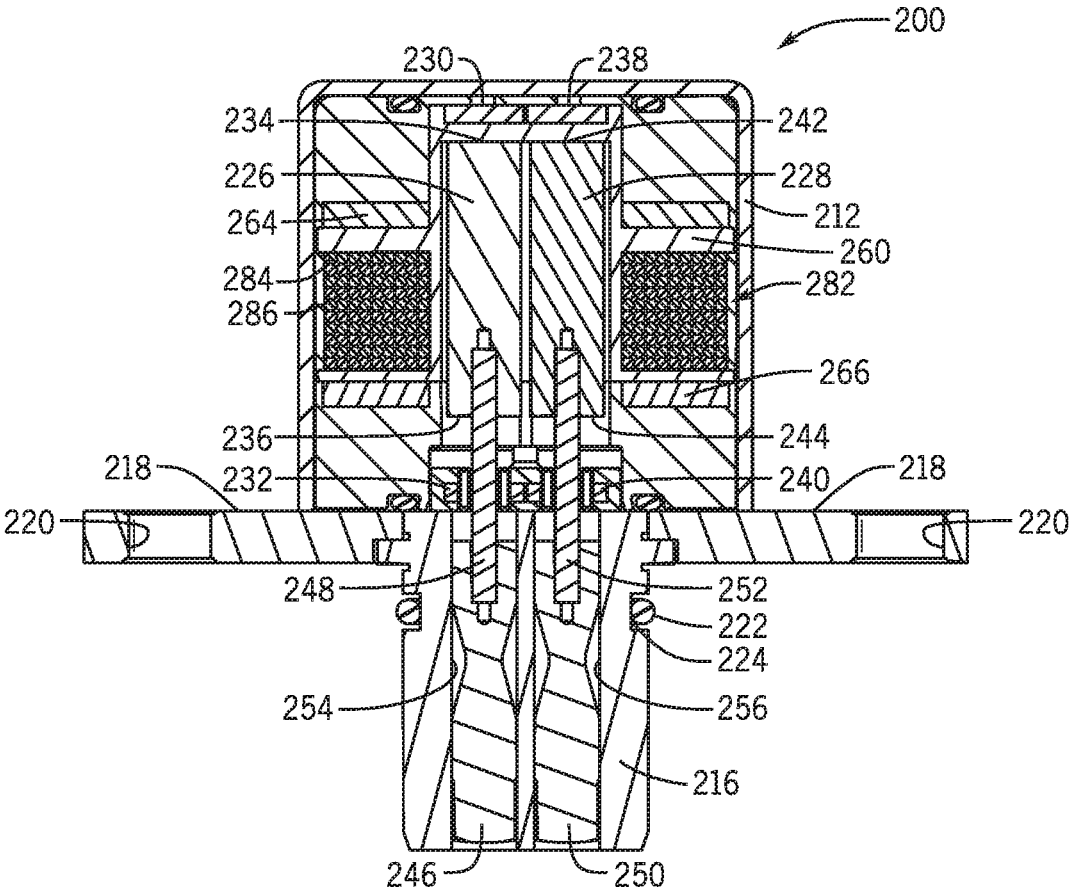
FIG. 10 shows the cross-sectional view of the push pin actuator apparatus of FIG. 3 with a dual-wound wire coil according to another embodiment of the present invention.

As described above, the push pin actuator apparatus 200 can independently actuate the first push pin 246 and the second push pin 250 by varying a direction and magnitude of a current applied to the wire coil 258. This can enable the push pin actuator apparatus 200 to utilize a single wire coil 258. However, in another embodiment shown in FIG. 10, the push pin apparatus 200 can include a dual wound wire coil 282 arranged in the recess 262. The dual wound wire coil 282 can include a first wire coil 284 wound in a first rotational direction and a second wire coil 286 wound in a second rotational direction opposite to the first rotational direction. The first wire coil 284 can be in an alternating arrangement with the second wire coil 286, as shown in FIG. 10. The use of the dual wound coil 282 can negate the need to reverse the direction of a current applied to the dual wound coil 282 during operation of the push pin actuator apparatus 200. Instead, a current can be selectively applied to the first wire coil 284 and the second wire coil 286 to generate a magnetic field in the desired direction.

Figure 11:
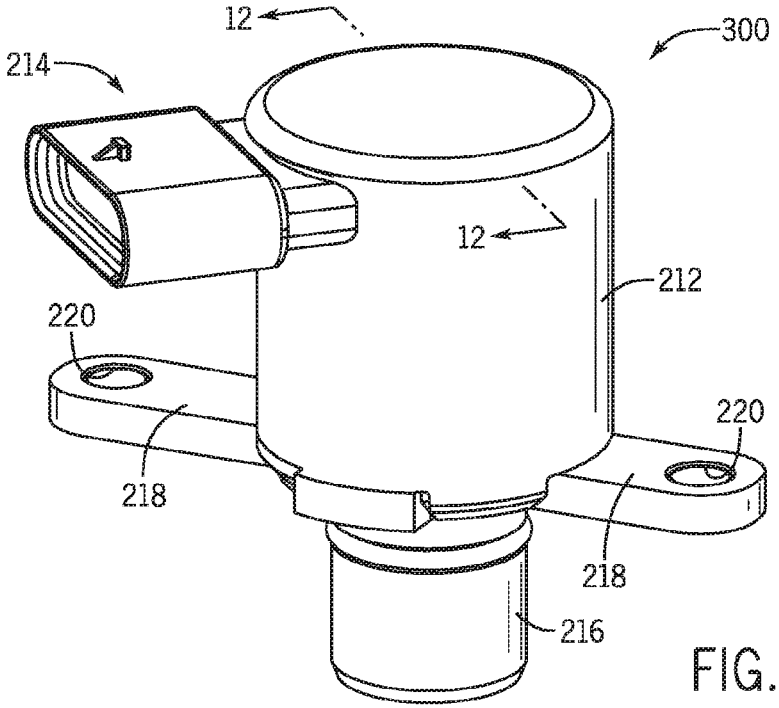
FIG. 11 shows a perspective view of a push pin actuator apparatus according to another embodiment of the present invention.
Figure 12:
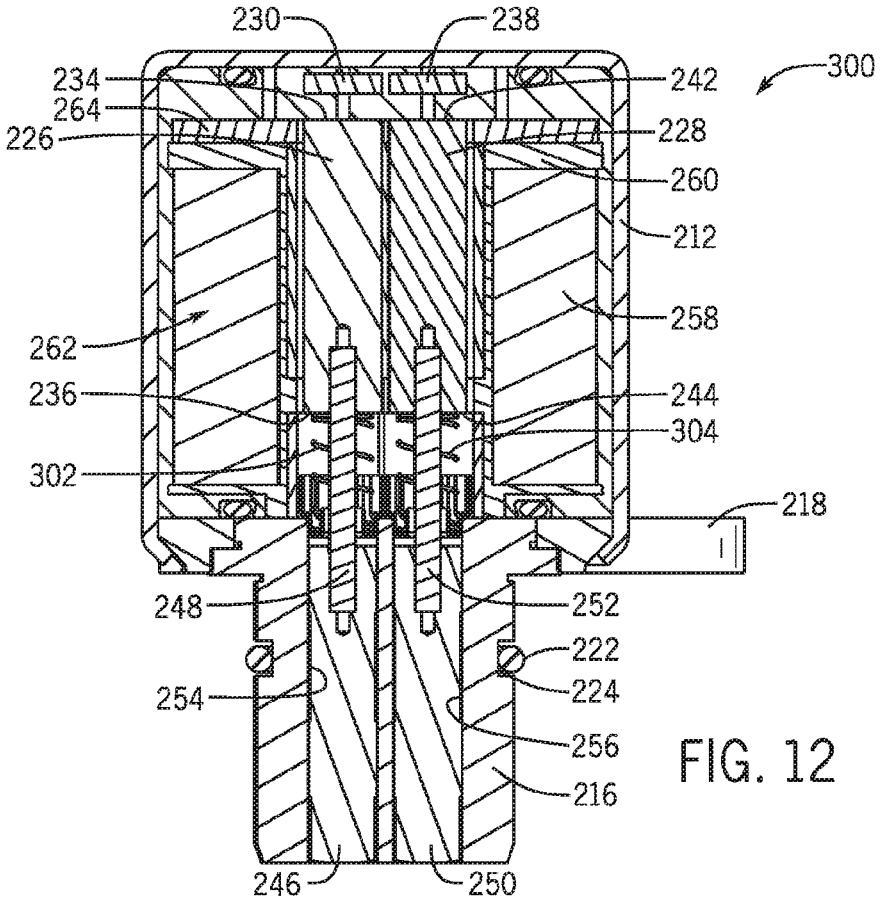
FIG. 12 shows a cross-sectional view of the push pin actuator apparatus of FIG. 11 taken along line 12-12.

FIGS. 11 and 12 show a push pin actuator apparatus 300 according to another embodiment of the present invention. The push pin actuator apparatus 300 can include similar features as the push pin actuator 200 except as described below or as seen from FIGS. 11 and 12. As shown in FIG. 11, the push pin actuator apparatus 300 may not include the second permanent magnet 232, the fourth permanent magnet 240, and the second pole piece 266. The wire coil 258 of the push pin actuator apparatus 300 can define a thickness or height which is approximately greater than or equal to the distance between the first surface 234 and the second surface 236 of the first armature 226. The push pin actuator apparatus 300 can include a first retraction spring 302 and a second retraction spring 304. The first retraction spring 302 can be arranged between the second surface 236 of the first armature 226 and the first push pin 246. The second retraction spring 304 can be arranged between the second surface 244 of the second armature 228 and the second push pin 250.

Operation of the push pin actuator 300 can be similar to the operation of the push pin actuator 200, described above, except as described below or as seen from FIGS. 11 and 12. In operation, the push pin actuator 300 can actuate the first armature 226 and the second armature 228 from the first armature position to the second armature by applying a current to the wire coil 528 in either the first direction 281 or the second direction 283. During actuation of the first armature 226 from the first armature position to the second armature position, the first retraction spring 302 can be compressed. Similarly, during actuation of the second armature 228 from the first armature position to the second armature position, the second retraction spring 304 can be compressed. The compression of the first retraction spring 302 and the second retraction spring 304 can require the current applied to the wire coil 258 in the respective direction to be maintained to enable the first push pin 246 or the second push pin 250 to remain extended from the push pin body 216. Once the current is removed from the wire coil 258, the first retraction spring 302 and the second retraction spring 304 can return the first armature 226 and the second armature 228 to the first armature position (thereby retracting the first push pin 246 and the second push pin 250 within the push pin body 216).

Figure 13:
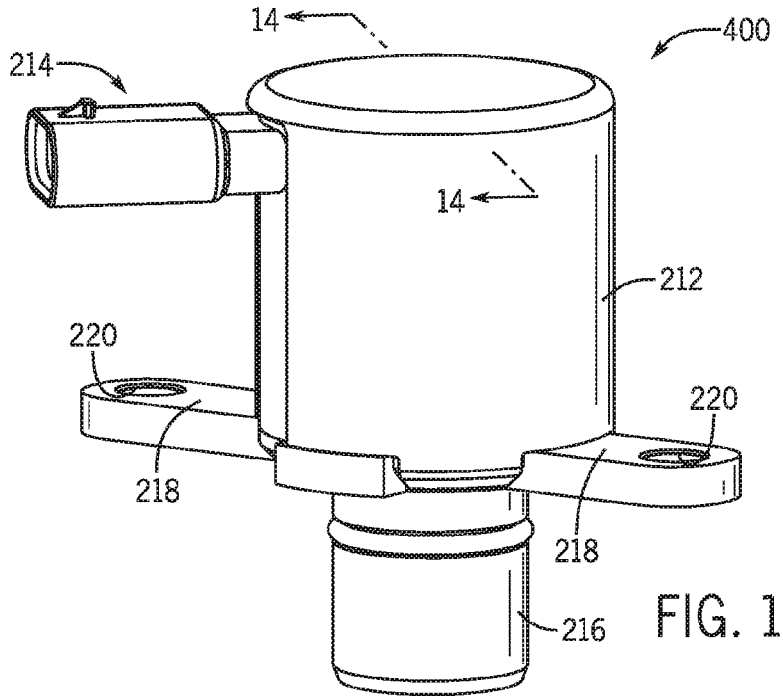
FIG. 13 shows a perspective view of a push pin actuator apparatus according to another embodiment of the present invention.
Figure 14:
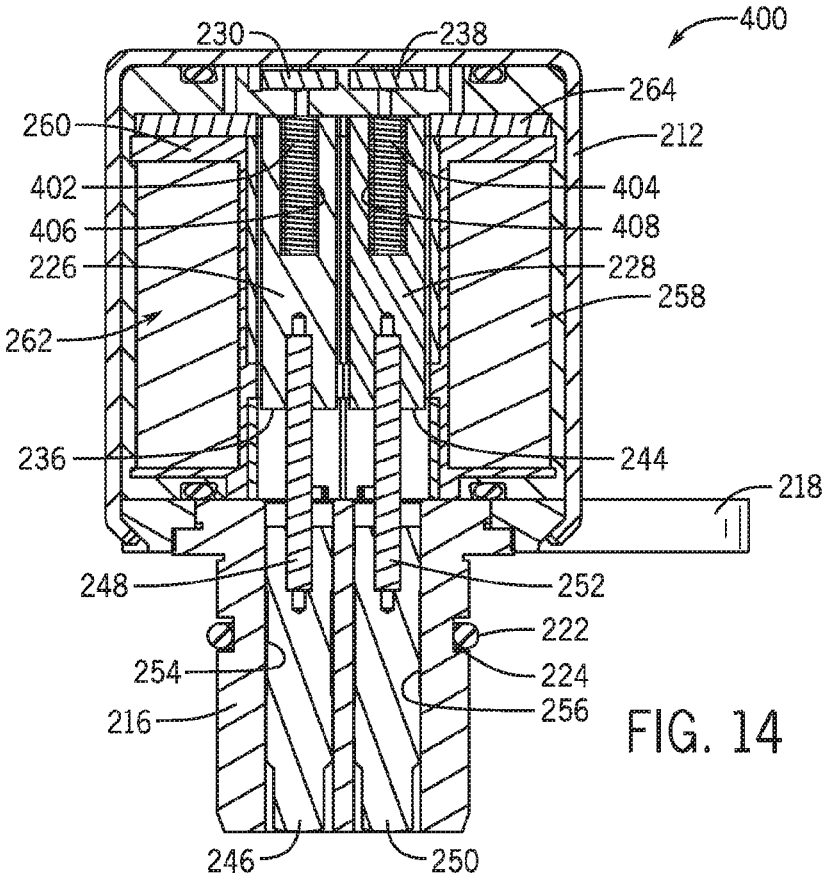
FIG. 14 shows a cross-sectional view of the push pin actuator apparatus of FIG. 13 taken along line 14-14.

FIGS. 13 and 14 show a push pin actuator apparatus 400 according to another embodiment of the present invention. The push pin actuator apparatus 400 can include similar features as the push pin actuator 200 except as described below or as seen from FIGS. 13 and 14. As shown in FIG. 14, the push pin actuator apparatus 400 may not include the second permanent magnet 232, the fourth permanent magnet 240, and the second pole piece 266. The wire coil 258 of the push pin actuator apparatus 400 can define a thickness or height which is approximately greater than or equal to the distance between the first surface 234 and the second surface 236 of the first armature 226. The push pin actuator apparatus 400 can include a first extension spring 402 and a second extension spring 404. The first extension spring 402 can be arranged within a first armature cavity 406 defined by the first armature 226. The second extension spring 404 can be arranged within a second armature cavity 408 defined by the second armature 228.

Operation of the push pin actuator 400 can be similar to the operation of the push pin actuator 200, described above, except as described below or is obvious from FIGS. 13 and 14. With no current applied to the wire coil 258, an attraction between the first permanent magnet 230 and the first armature 226 can be greater than a force acting on the first armature 226 by the first extension spring 402 in an opposing direction (i.e., towards the second armature position). Similarly, an attraction between the third permanent magnet 238 and the second armature 228 can be greater than a force acting on the second armature 228 by the second extension spring 404 in an opposing direction (i.e., towards the second armature position). Once a current is applied to the wire coil 258 in a desired direction (i.e., either the first direction 281 or the second direction 283), the attraction between the first permanent magnet 230 and the first armature 226 or between the third permanent magnet 238 and the second armature 228 can be overcome. Once the attraction between either the first permanent magnet 230 and the first armature 226 or between the third permanent magnet 238 and the second armature 228 is overcome, the respective extension spring 402 or 404 can actuate either the first armature 226 or the second armature 228 from the first armature position to the second armature position. If the current is removed from the wire coil 258 once either the first armature 226 or the second armature 228 are in the second armature position, an extension force provided by the first extension spring 402 and the second extension spring 404 can enable the first armature 226 or the second armature 228 to remain in the second armature position. Thus, the push pin actuator apparatus 400 may not require continuous current to be applied to the wire coil 258 following actuation of either the first armature 226 or the second armature 228 from the first armature position to the second armature position. However, this extension force can require the cam shaft (not shown) in a cam profile switching system to manually actuate the first armature and the second armature from the second armature position back to the first armature position.

Figure 15:
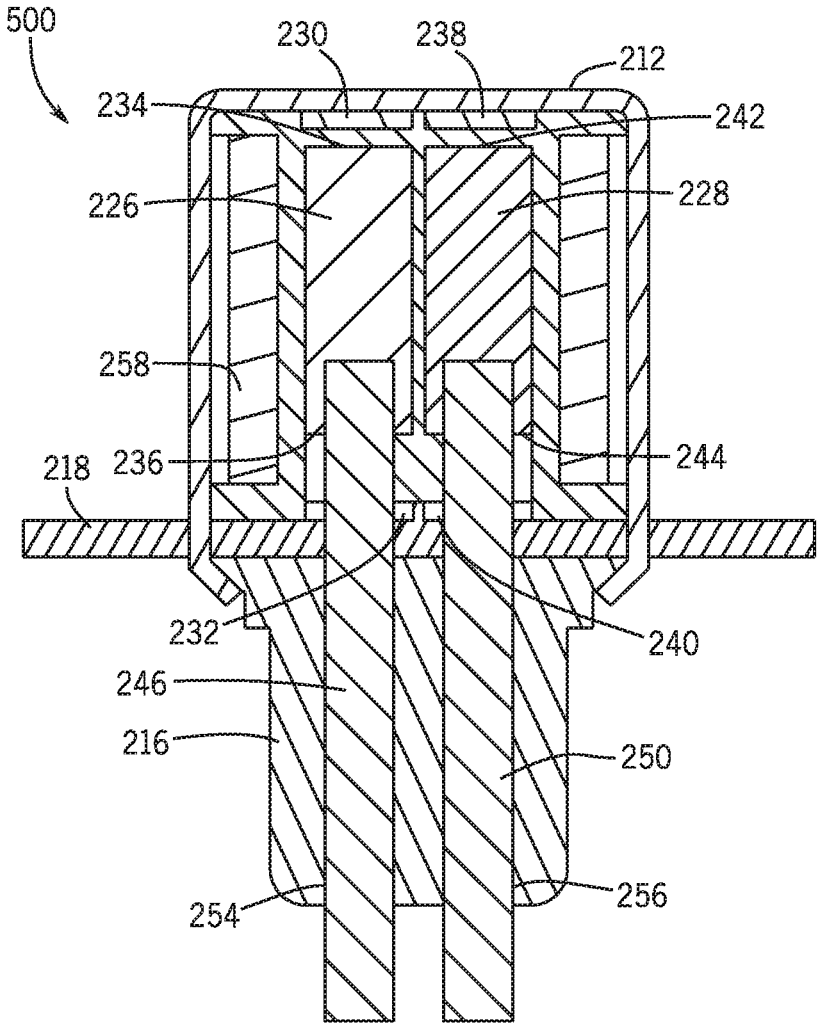
FIG. 15 shows a schematic of a push pin actuator apparatus according to yet another embodiment of the present invention.

FIG. 15 shows a push pin actuator apparatus 500 according to yet another embodiment of the present invention. The push pin actuator apparatus 500 can include similar features as the push pin actuator 200 except as described below or as seen from FIG. 15. As shown in FIG. 15, the push pin actuator apparatus 500 may not include the first coupling rod 248, the second coupling rod 252, the first pole piece 264, and the second pole piece 266. The wire coil 258 of the push pin actuator apparatus 500 can define a thickness or height which is approximately greater than or equal to the distance between the first surface 234 and the second surface 236 of the first armature 226. The first armature 226 can be directly coupled to the first push pin 246, and the second armature 228 can be directly coupled to the second push pin 250. The operation of the push pin actuator apparatus 500 can be similar to the operation of the push pin apparatus 200, described above, except the push pin actuator apparatus 500 may experience a higher side loading effect and lower output forces without the first pole piece 264 or the second pole piece 266.

While the push pin actuator apparatuses 200, 300, 400 and 500 were described with respect to a cam profile switching system, it should be appreciated that the techniques and properties of the push pin actuator apparatuses 200, 300, 400, and 500 may be applied to other systems requiring independent actuation of a first push pin and a second push pin.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A push pin actuator apparatus comprising:

a housing;

a wire coil arranged within the housing and arranged around a first armature and a second armature, the first armature coupled to a first push pin and the second armature coupled to a second push pin, the first armature and the second armature each moveable between a first armature position and a second armature position;

a first permanent magnet arranged adjacent to a first surface of the first armature, and a second permanent magnet arranged adjacent to a first surface of the second armature;

a pole piece arranged within the housing and including a cutout for receiving the first armature and the second armature;

a first spring and a second spring each arranged within the housing, the first spring engaging the first armature and the second spring engaging the second armature; and wherein the first push pin is actuated in response to a current being applied to the wire coil in a first direction, and the second push pin is actuated in response to a current being applied to the wire coil in a second direction opposite to the first direction.

2. The push pin actuator apparatus of claim 1, wherein the first spring retracts the first armature from the second armature position to the first armature position when the current applied to the wire coil in the first direction is removed, and the second spring retracts the second armature from the second armature position to the first armature position when the current applied to the wire coil in the second direction is removed.

3. The push pin actuator apparatus of claim 1, wherein the first spring extends the first armature from the first armature position to the second armature position when the current in the first direction is applied to the wire coil, and the second spring extends the second armature from the first armature position to the second armature position when the current in the second direction is applied to the wire coil.

4. The push pin actuator apparatus of claim 1, wherein the first spring is arranged within a first cavity defined by the first armature, and the second spring is arranged within a second cavity defined by the second armature.

5. The push pin actuator apparatus of claim 1, wherein the cutout of the pole piece eccentrically receives the first armature and the second armature.

6. The push pin actuator apparatus of claim 1, wherein the first spring is biased between a second surface of the first armature and the first push pin, and the second spring is biased between a second surface of the second armature and the second push pin.

7. The push pin actuator apparatus of claim 6, wherein the wire coil defines a height that is greater than or equal to a distance between the first surface and the second surface of the first armature.

8. The push pin actuator apparatus of claim 1, wherein the cutout at least partially receives the first armature in the first armature position and the second armature in the first armature position.

9. A push pin actuator apparatus comprising:

a housing;

a wire coil arranged within the housing and arranged around a first armature and a second armature, the first armature coupled to a first push pin and the second armature coupled to a second push pin, the first armature and the second armature each moveable between a first armature position and a second armature position;

a first permanent magnet arranged adjacent to a first surface of the first armature, and a second permanent magnet arranged adjacent to a first surface of the second armature;

a pole piece arranged within the housing and including a cutout for receiving the first armature and the second armature;

a first spring arranged within a first cavity defined by the first armature;

a second spring arranged within a second cavity defined by the second armature; and wherein the first push pin is actuated in response to a current being applied to the wire coil in a first direction, and the second push pin is actuated in response to a current being applied to the wire coil in a second direction opposite to the first direction.

10. The push pin actuator apparatus of claim 9, wherein the first spring extends the first armature from the first armature position to the second armature position when the current in the first direction is applied to the wire coil, and the second spring extends the second armature from the first armature position to the second armature position when the current in the second direction is applied to the wire coil.

11. The push pin actuator apparatus of claim 9, wherein the cutout of the pole piece eccentrically receives the first armature and the second armature.

12. The push pin actuator apparatus of claim 9, wherein the wire coil defines a height that is greater than or equal to a distance between the first surface and the second surface of the first armature.

13. The push pin actuator apparatus of claim 9, wherein the cutout at least partially receives the first armature in the first armature position and the second armature in the first armature position.

14. The push pin actuator apparatus of claim 9, wherein when no current is applied to the wire coil, a first attraction between the first permanent magnet and the first armature is greater than a first spring force acting on the first armature by the first spring, and a second attraction between the second permanent magnet and the second armature is greater than a second spring force acting on the second armature by the second spring.

15. The push pin actuator apparatus of claim 9, wherein the first cavity extends within the first armature from the first surface to a location between the first surface and the second surface, and the second cavity extends within the second armature from the first surface to a location between the first surface and the second surface.

* * * * *